US012723533B1

(12) United States Patent
Getter

(10) Patent No.: US 12,723,533 B1
(45) Date of Patent: Sep. 1, 2026

(54) DIESEL EXHAUST FLUID SENSOR SIMULATOR DEVICE

(71) Applicant: John Getter, Stillwater, MN (US)

(72) Inventor: John Getter, Stillwater, MN (US)

( * ) Notice: Subject to any disclaimer, the term of this patent is extended or adjusted under 35 U.S.C. 154(b) by 0 days.

(21) Appl. No.: 19/573,139

(22) Filed: Mar. 20, 2026

(51) Int. Cl.
*F01N 11/00* (2006.01)
*F01N 3/20* (2006.01)

(52) U.S. Cl.
CPC ..... *F01N 11/00* (2013.01); *F01N 3/2066* (2013.01); *F01N 2550/03* (2013.01)

(58) Field of Classification Search
CPC ..... F01N 11/00; F01N 3/2066; F01N 2550/03
See application file for complete search history.

(56) References Cited

U.S. PATENT DOCUMENTS 10,190,470 B2 * 1/2019 Tuken ..... F01N 11/002
2021/0062701 A1 * 3/2021 Dea ..... B01D 29/27
2022/0127988 A1 * 4/2022 Rockey ..... F01N 3/2066
2022/0258751 A1 * 8/2022 Dane ..... H04W 4/48
2024/0264134 A1 * 8/2024 Charintranond ..... G01N 33/00

* cited by examiner

*Primary Examiner* — Scott A Browne
*Assistant Examiner* — Izcalli Rios-Aguirre
(74) *Attorney, Agent, or Firm* — Bruce A. Lev

(57) ABSTRACT

A diesel exhaust fluid (DEF) sensor simulator device adapted to be electronically connected to the engine control module (ECM) of a diesel engine and adapted to replace or override electronic signals being sent from an existing DEF header, that is connected between a DEF fluid tank and an ECM of the diesel engine, and send simulated analog or digital signals to the ECM to avoid a sudden reduction in power of the diesel engine, and thereby the power and speed of a diesel vehicle using the diesel engine, during failure of any of the components of the emission system of the diesel vehicle resulting in DEF readings showing that the fuel tank is empty, the fluid temperature is out of a required range, or the fluid quality is out of a required range.

6 Claims, 5 Drawing Sheets

DIESEL EXHAUST FLUID SENSOR SIMULATOR DEVICE

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

1. Field of the Invention

This invention relates generally to diesel engines, and more specifically to emission systems and controls for a diesel engine.

2. Description of the Related Art

Prior art diesel engines are vulnerable to breakdowns caused by the failure of a component in its emissions control system. These breakdowns leave the driver with either a derated speed limit of 5 mph hour or a full engine stop with no ability to restart. This is an extremely dangerous condition as it can happen with no prior warning while the vehicle is travelling at highways speeds. This device can be used in the RV, over the road trucks, emergency vehicles, construction vehicles, farming vehicles, etc. The device that fails is the DEF (Diesel Exhaust Fluid) head that is mounted on top of the DEF fluid tank. The purpose of this device is to perform several functions, including measuring the level of the DEF fluid in the DEF fluid tank, the temperature of the DEF fluid, inlet and output ports for the DEF fluid, inlet and output ports for engine coolant, and in the case of vehicles 2017 and newer, measure the quality of the DEF fluid within the tank.

Diesel Exhaust Fluid (DEF) quality is defined by a precise mixture of 32.5% high-purity urea and 67.5% deionized water, adhering to ISO 22241 standards to ensure proper Selective Catalytic Reduction (SCR) system function. High-quality DEF is clear, colorless, and free from contaminants like dirt, oil, or water.

When the DEF head fails it will send erroneous reading to the engine ECM indicating that that either the tank is empty, the fluid temperature is out of range, or the quality is out of range. Based on these erroneous readings, the ECM will either start a derate process (reducing power and max speed) that will last minutes or demand that the driver pull over stop the vehicle immediately, then shutdown the engine. This derate process will occur despite the fact that the emission control system can pull fluid from the tank, pressurize this fluid, inject the fluid into the exhaust, measure the injection rate of the fluid, measure the exhaust emissions, and determine it is still in compliance. The EPA mandated that at the first sign of trouble, then vehicle must go into a derate mode until fixed. This leaves the driver stranded until a mobile technician arrives or the vehicle is towed to a shop for repair, which can take several days or weeks depending on whether parts are available.

Starting in 2010, diesel engines required using Diesel Exhaust Fluid (DEF fluid) for the Selective Catalytic Reduction (SCR) system. A SCR system is an advanced, active emissions control technology used in modern diesel engines to reduce harmful nitrogen oxide (NOx) emissions by up to 90%. It works by injecting a urea-based liquid, called Diesel Exhaust Fluid (DEF), into the exhaust stream, where a catalyst converts the gases into harmless nitrogen and water.

DEF Sensor Issues: The DEF head is inserted into the top of the DEF tank. The head consists of the DEF pickup tube, the engine coolant heater tube, and the DEF sensors. The sensors were originally designed to sense the level of DEF in the tank and the temperature of the fluid for 2010-2016 (analog version). In 2017 and thereafter, the EPA mandated that new sensor designs were required that also detected the concentration level of DEF to ensure that owners weren't diluting their DEF with water and rendering the emissions system ineffective. These sensors were digital based. These sensors showed up mainly in the 2017 (Digital) model year coaches.

2010-2016 DEF heads (analog version): While the original 2016 and prior year sensors were relatively trouble-free, they start failing on a consistent basis at the 10-year or about the 75,000 mile mark. These sensors had issues where the fluid level or temperature had failed. When the sensor failed the engine would shut down with a maximum speed of 5 mph, and typically displaying one of the following, "SPN 1761 FMI 9 (Cummins Fault Code 4677)—DEF tank level" or "SPN 3031 FMI 9 (Cummins Fault Code 4572)—DEF tank temperature".

2017-present DEF heads: After the 2017 sensors were introduced, they began failing at a rapid rate. These sensors had issues where the electronic circuit board had failed. When the sensor failed the engine would shut down, typically displaying one of the following fault codes showing abnormal update rates, "SPN 3364 FMI 9 (Cummins Fault Code 3868)—DEF quality", "SPN 1761 FMI 9 (Cummins Fault Code 4677)—DEF tank level", or "SPN 3031 FMI 9 (Cummins Fault Code 4572)—DEF tank temperature". These codes were designed to detect weak DEF, low DEF level or DEF that had been overheated in the tank. If the sensor chip fails any one of these fault codes may appear, even though there is nothing wrong with the DEF itself. But the faulty sensor will derate and eventually shut down your engine with a maximum speed of 5 MPH. When a DEF head fails and puts the vehicle into a maximum speed of 5 mph, it creates a severe challenge for the driver. They have a limited amount of time to get off the roadway to safe spot to park. After this limited time has expired, the vehicle will no longer start and be in a full shutdown mode. To correct this problem, the DEF head will have to be replaced by either calling a mobile technician or get towed to a service center. Either way, the driver usually is stranded for days or weeks waiting for the vehicle to be fixed.

Therefore, a need exists for a rapid solution to get the driver moving again on the journey. The solution is to provide an electronic box to allow the driver to unplug the cable from the current DEF head, and plug into the electronic box. This box will then simulate electrical signals corresponding to DEF tank that has fluid in it, the fluid temperature is above the freezing point of the DEF fluid, and that the fluid quality is acceptable. To install this electronic box requires 1-2 hours, basic electric/mechanical skills, ability to get on ones knees, reach inside a hot dirty area with limited visibility, select the correct wiring harness, cut the appropriate tie wraps, unplug the proper electrical connector, plug the box into the electrical connect, then tie wrap everything securely down. While this process is straightforward for an experienced mechanic, it will sometimes require a mobile technician to get accomplished. The typical wait time for a technician could be hours or day with a cost of $500-$1500.

Therefore, a proactive need exists for pre-installing a selector switch and a DEF simulator box. This solution would have a technician install the selector switch and electronic box ahead of time, so when the original DEF head fails, the driver simply pulls over, shuts off the engine, switches to the DEF simulator box, starts up the engine, then continues on the journey.

BRIEF SUMMARY OF THE INVENTION

In view of the foregoing disadvantages inherent in the known types of diesel exhaust fluid (DEF) sensors or the like in the prior art, the present invention provides a diesel exhaust fluid (DEF) sensor simulator device adapted to be electronically connected to the engine control module (ECM) of a diesel engine and adapted to replace or override electronic signals being sent from an existing DEF header, that is connected between a DEF fluid tank and an ECM of the diesel engine, and send simulated analog or digital signals to the ECM to avoid a sudden reduction in power of the diesel engine, and thereby the power and speed of a diesel vehicle using the diesel engine, during failure of any of the components of the emission system of the diesel vehicle resulting in DEF readings showing that the fuel tank is empty, the fluid temperature is out of a required range, or the fluid quality is out of a required range, with all the advantages of the prior art and none of the disadvantages.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

BRIEF DESCRIPTION OF THE DRAWINGS

The figures which accompany the written portion of this specification illustrate embodiments according to the teachings of the present invention.

Figure 1:
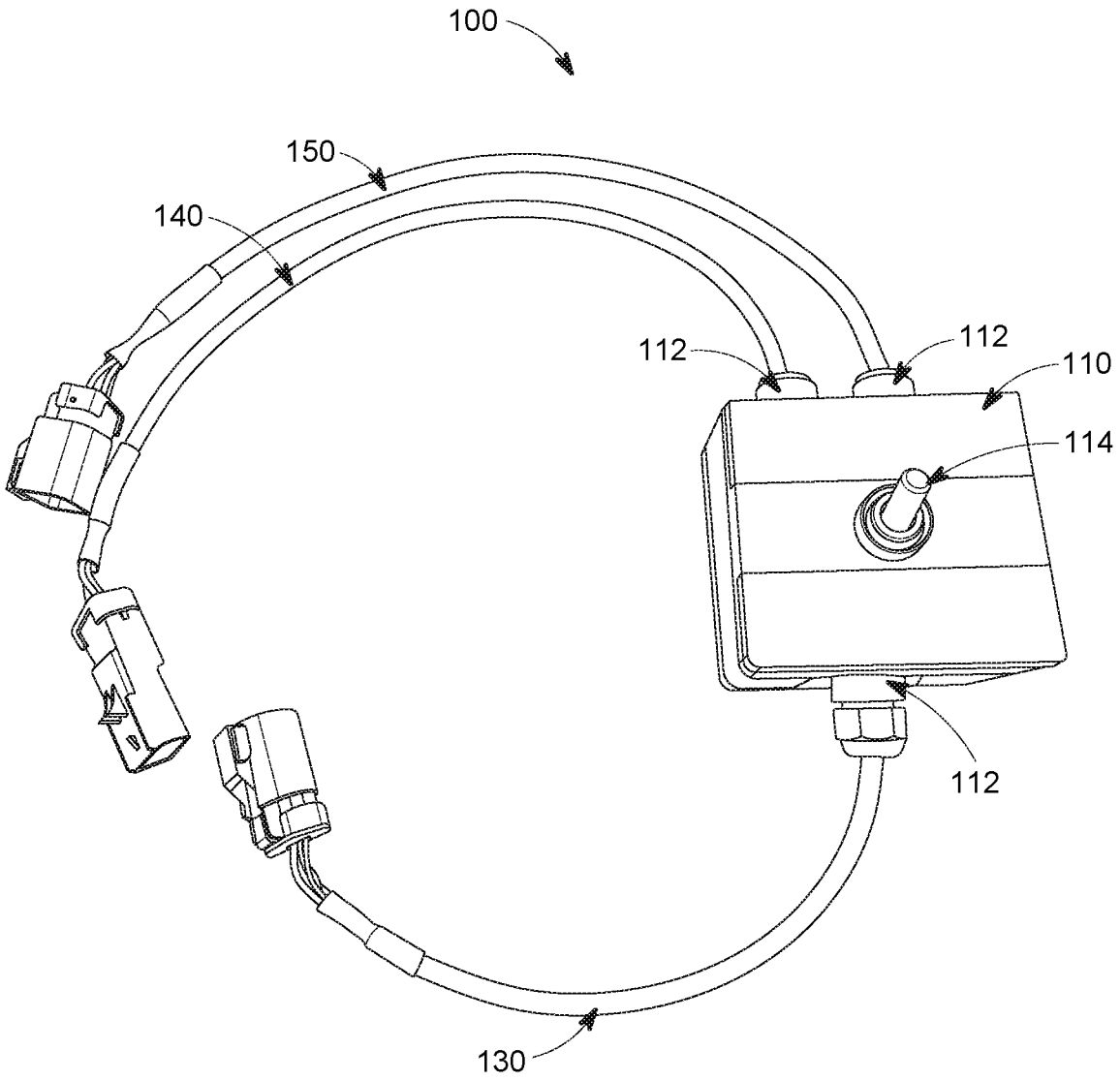
FIG. 1 shows a top view of the diesel exhaust fluid sensor simulator device according to the preferred embodiment of the present invention.

The various embodiments of the present invention will hereinafter be described in conjunction with the appended drawings.

DETAILED DESCRIPTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

The following embodiments and the accompanying drawings, which are incorporated into and form part of this disclosure, illustrate embodiments of the invention and together with the description, serve to explain the principles of the invention. To the accomplishment of the foregoing and related ends, certain illustrative aspects of the invention are described herein in connection with the following description and the annexed drawings. These aspects are indicative, however, of but a few of the various ways in which the principles of the invention can be employed and the subject invention is intended to include all such aspects and their equivalents. Other advantages and novel features of the invention will become apparent from the following detailed description of the invention when considered in conjunction with the drawings.

The instant DEF sensor simulator device 100 consists of a waterproof box or other encasement type 110, which could be made from metal or plastic, an electrical circuit board 160, a minimum of 3 conductor wires 130, 140, and 150, of varying lengths that could be shielded or non-shielded, with or without a grounding drain wire, and which will pass thru the box then terminate in the appropriate connector that could be weather resistant or not and that corresponds to the chassis being interfaced with. In use, a person disconnects the existing DEF head cable 212 from the engine control module (ECM) 300, and then plugs the first wire 130 of the DEF sensor simulator device 100 thereto. The connection can be made with or without the engine ignition on. Once the ignition is turned on, the DEF sensor simulator device 100 will supply a signal voltage for the fluid of the tank that will correspond to 0 to 100%, and a supply a signal voltage for the temperature of the fluid of the tank that will correspond to −50 to 300 degrees F.

In an analog embodiment of the present invention, the purpose is to supply DC voltage corresponding to the fluid level and fluid temperature to the ECM 300. This DC voltage is developed using supplied voltage from the ECM and creates a voltage drop across a variable resistance created by a fluid level sensor and thermistor for measuring the temperature. When a DEF head 210 fails, either one or both of these signals goes out of range, thereby triggering the ECM 300 to put the vehicle into a derate mode. In these situations, the fluid level and fluid temperature are sent via two wire devices. On some vehicle chassis, a three wire device is used to measure the fluid level. The three wire device uses either a 5 v or 12 v DC signal supplied by the ECM, then converted into a voltage level, then sent it back to the ECM. These 3 wire devices were phased out in early 2020's, and now all DEF heads are two wire devices.

In the analog embodiment, the ECM 300 sends out 5-volt power to passive resistors R1 and R2 within the electronic circuit board 160, wherein the passive resistors have an ohm value that corresponds to ~75% full of the DEF fluid level and ~75 degrees Fahrenheit for the fluid temperature. Furthermore, a thermistor can be substituted for the temperature resistor within the electronic circuit board to obtain a value that varies with ambient air temperature. Furthermore, an external thermistor that interfaces with the diesel exhaust fluid tank connected via an external cable can also obtain an accurate reading of the fluid temperature. Furthermore, a resistor for the fluid level could be substituted for an external float switch that can be introduced into the tank via its fill cap.

In the past, there has been no solution to the analog DEF head failures other than installing a new head. The instant invention uses two fixed resistor values of 470 ohms that in conjunction with the supplied 5 v DC creates the voltage signals that correspond roughly to a tank level of 75% and 75 degrees Fahrenheit. The enhanced analog solution adds the ability to measure the temperature of the fluid and fluid level either variable or fixed.

In the digital embodiment of the present invention, the purpose is to supply Can Bus messages to the ECM corresponding to the fluid level, fluid temperature, and the DEF fluid quality (which was a new requirement starting in 2017). These three parameters/readings are created by using the supplied 12 v DC signal from each measurement device. These three signals are then sent to an onboard processor 180 that creates the required Can Bus messages. The DEF head typically fails in the following modes. One, the processor fails then none of the three messages are created and sent, which is most common. And two, either one, both, or all three of the parameter are out of range. If either of the events occurs it will trigger the ECM to put the vehicle into a derate mode.

In the digital embodiment of the present invention, the ECM 300 supplies 12-volt DC power for the electronic circuit board. The electronic circuit board 160 then uses this voltage to power itself, then sends communications out onto a data link communications bus 190 thereon. In this embodiment, the electronic circuit board may utilize open source coding to that sends signals to the ECM 300 that the fluid level is ~75% full and the fluid temperature is ~75 degrees Fahrenheit.

Part of the digital solution includes a Can Bus CPU 170 device programmed with selected values for the tank of level of 75%, fluid temperature of 75 degree Fahrenheit, and a DEF fluid quality of 32.5%. The enhanced digital solution includes measuring the temperature of the fluid, measure the fluid level either with variable or fixed device, and measure the DEF fluid quality.

The preferred embodiment of the present invention discloses the two wires 140 and 150 connected to the electronic circuit board and extending outward therefrom and both adapted to be releasably connect to the engine control module 300 of the diesel engine. However, a second embodiment can be formed wherein the two wires are connected together in parallel such that the switch can be used to choose between the two without having to disconnect or reconnect the wires to the ECM 300.

Figure 2:
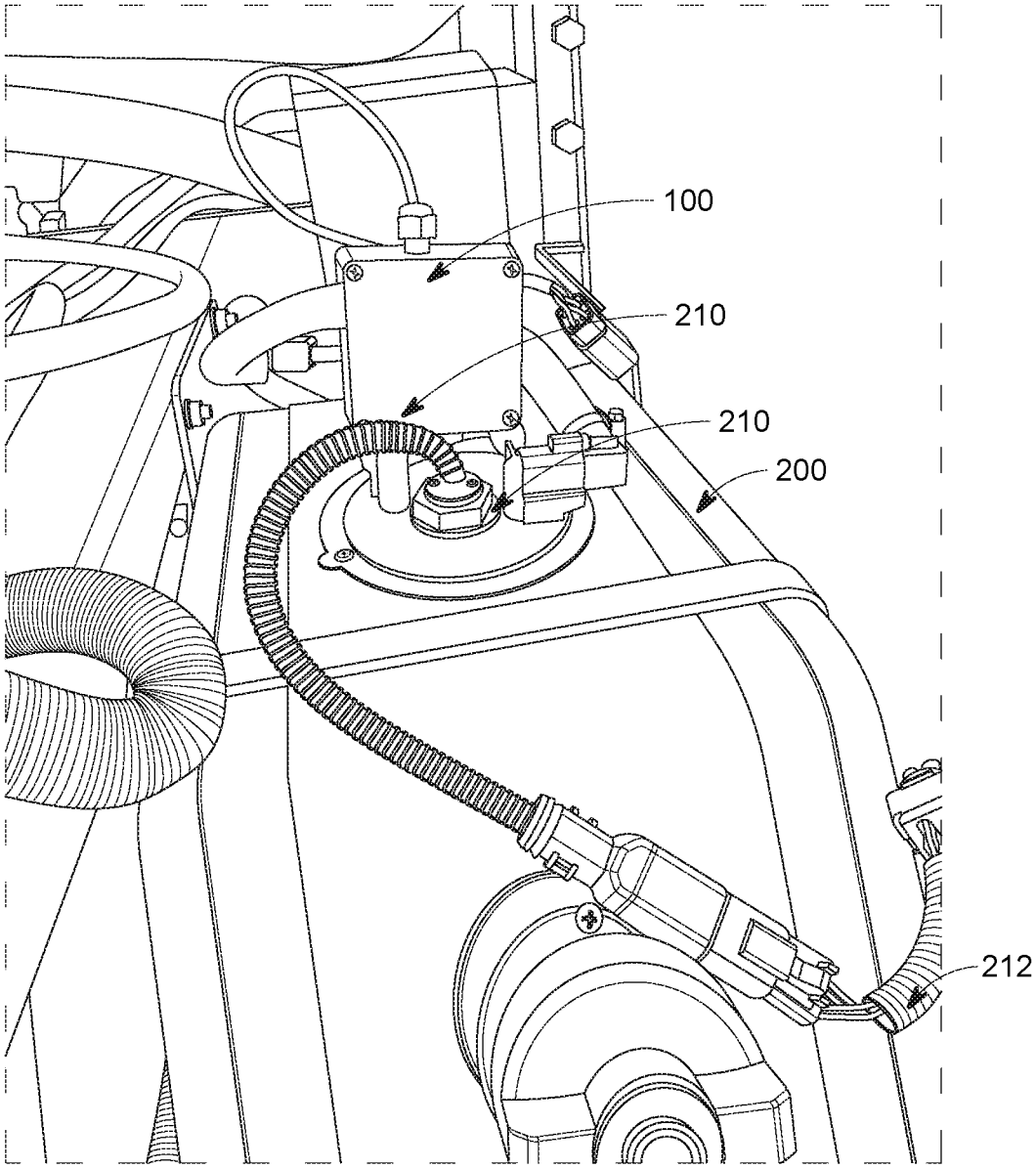
FIG. 2 shows a perspective view of the diesel exhaust fluid sensor simulator device connected to a diesel exhaust fluid tank according to the preferred embodiment of the present invention of FIG. 1.
Figure 3:
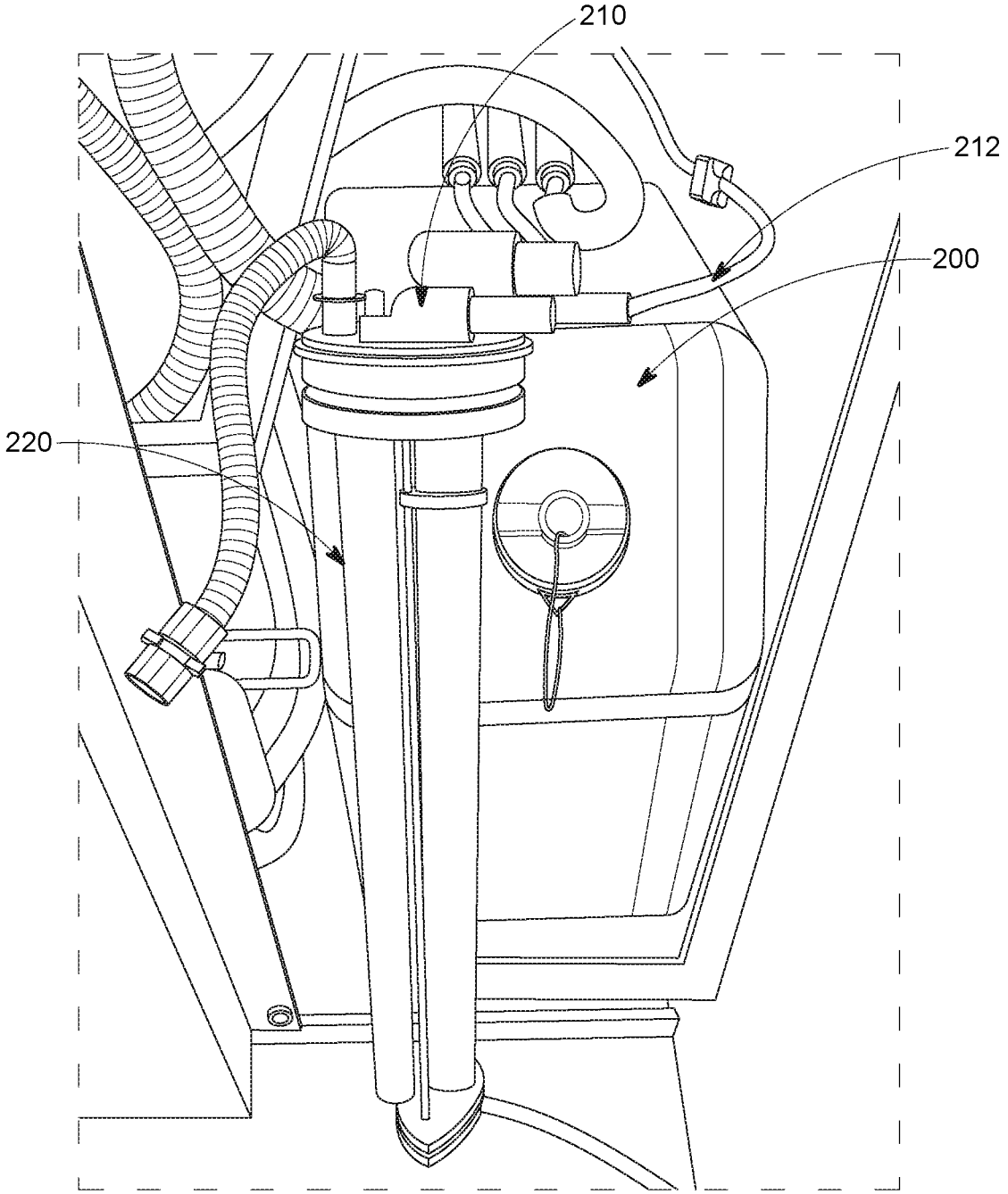
FIG. 3 shows a perspective view of the diesel exhaust fluid head disconnected from the diesel exhaust fluid tank according to the preferred embodiment of the present invention of FIG. 1.
Figure 4:
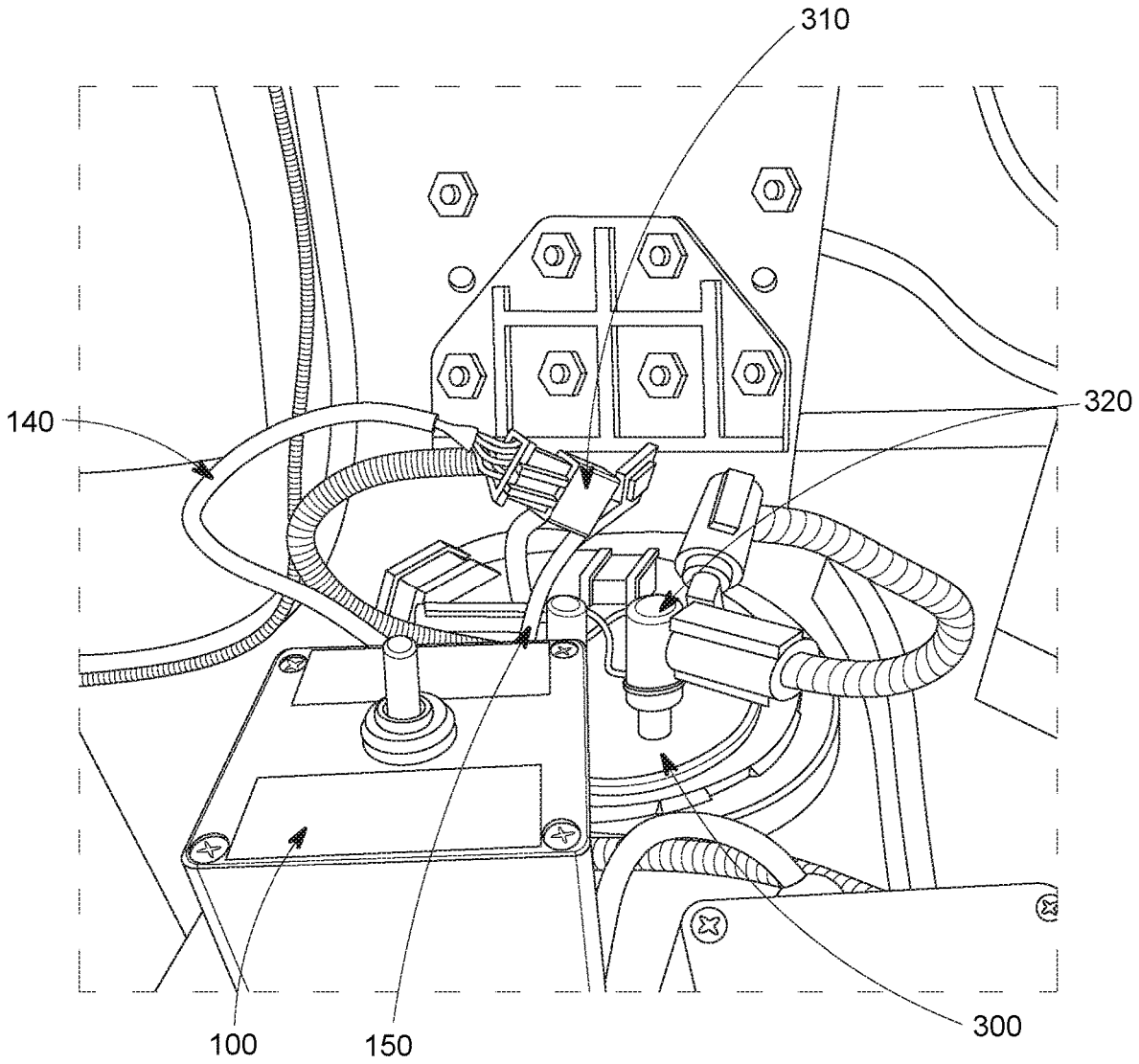
FIG. 4 shows a perspective view of the diesel exhaust fluid sensor simulator device connected to the engine control module according to the preferred embodiment of the present invention of FIG. 1.
Figure 5:
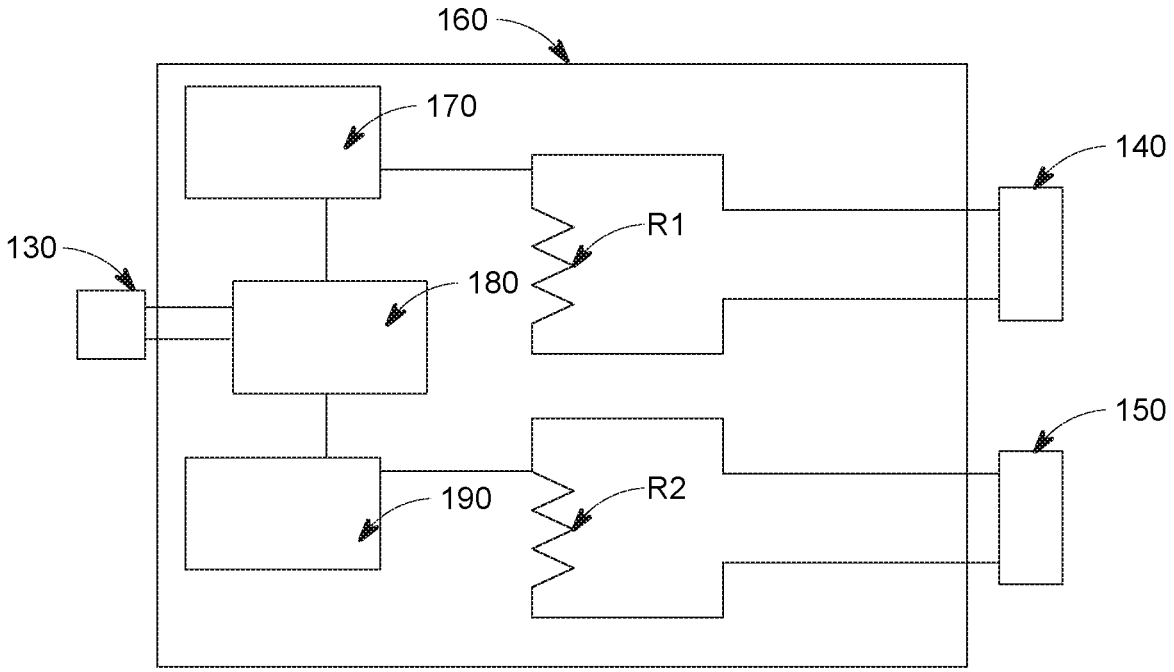
FIG. 5 shows an electronic schematic of the electronic circuit board of the diesel exhaust fluid sensor simulator according to the preferred embodiment of the present invention of FIG. 1.

Turning now descriptively to drawing, referring to FIGS. 1-5, the present invention discloses a diesel exhaust fluid sensor simulator device 100 for use between an engine control module (ECM) 300 of a diesel engine and a diesel exhaust fluid head 210 of a diesel exhaust fluid tank 200. The engine control module (ECM) 300 includes an electronic input connector 310, and an electronic output connector 320, wherein the engine control module 300 is adapted to be electronically connected between the diesel exhaust fluid head 210 and an engine of a diesel vehicle. The diesel exhaust fluid head 210 includes a sensor 220 adapted to retrieve information pertaining to diesel exhaust fluid within a diesel exhaust fluid tank 200, wherein the diesel exhaust fluid head is adapted to be releasably connected to the diesel exhaust fluid tank.

The diesel exhaust fluid sensor simulator device 100 comprises an encasement 110 that includes an interior volume formed by at least one wall, and at least one wiring aperture 112 through the at least one wall; an electronic circuit board 160 located within the interior volume of said encasement and is adapted to retrieve electronic signals from the diesel exhaust fluid head 210 correlating to an actual diesel exhaust fluid level within the diesel exhaust fluid tank 200, and an actual temperature of the diesel exhaust fluid via a first wire 130 connected therebetween, and wherein the electronic circuit board 160 is adapted to send electronic signals correlating to the actual diesel exhaust fluid level within the diesel exhaust fluid head 210, and the actual temperature of the diesel exhaust fluid to the engine control module 300 via a second wire 140 connected therebetween, and wherein the electronic circuit board 160 is adapted to produce electronic signals correlating to a chosen diesel exhaust fluid level within the diesel exhaust fluid head, and a chosen temperature of the diesel exhaust fluid and send to said engine control module via a third wire 150 connected therebetween. The first wire 130 is connected to the electronic circuit board 160 and extends outward therefrom through a wiring aperture and is adapted to be releasably connected to the diesel exhaust fluid head 210 of the diesel exhaust fluid tank 200, and wherein the first wire 130 is adapted to retrieve and send the electronic signals correlating to the actual diesel exhaust fluid level within the diesel exhaust fluid tank, and the actual temperature of the diesel exhaust fluid to the electronic circuit board. The second wire 140 is connected to the electronic circuit board 130 and extends outward therefrom through the wiring aperture and is adapted to be releasably connected to the engine control module 300 of the diesel engine, and wherein the second wire 140 is adapted to send the electronic signals correlating to the actual diesel exhaust fluid level within the diesel exhaust fluid tank, and the actual temperature of the diesel exhaust fluid retrieved from the diesel exhaust fluid head to the engine control module. And, a third wire 150 connected to the electronic circuit board 160 and extends outward therefrom through a wiring aperture and is adapted to be releasably connected to the engine control module 300 of the diesel engine, and wherein the third wire 150 is adapted to send the produced electronic signals correlating to the chosen diesel exhaust fluid level within the diesel exhaust fluid tank, and the chosen temperature of the diesel exhaust fluid to the engine control module 300. The diesel exhaust fluid sensor simulator device 100 further comprises a switch 114 connected to an exterior surface of the encasement 110, wherein the switch 114 is electronically connected to the electronic circuit board 160, and wherein the switch is adapted such that a user can choose between sending the electronic signals of the second wire 140, the actual diesel exhaust fluid level and temperature, and sending the electronic signals of the third wire 150, the chosen diesel exhaust fluid level and temperature to the engine control module 300.

When in use, when the fluid level or temperature readings are out of a predetermined range, which may cause the diesel engine to reduce power or shut down, a user can use the switch 114 to block the out of range readings and instead send the chosen fluid level and temperature readings to the engine control module to regain use and control of the diesel engine.

In the preferred embodiment, the chosen diesel exhaust fluid level within the diesel exhaust fluid tank 200 correlates to substantially 75% full, and the chosen temperature of the diesel exhaust fluid correlates to substantially 75 degrees Fahrenheit. Furthermore, the electronic circuit board 160 is adapted to produce electronic signals correlating to a chosen quality of the diesel exhaust fluid within the diesel exhaust fluid tank, and wherein the third wire 150 is adapted to send the produced electronic signals correlating to the chosen quality of the diesel exhaust fluid within the diesel exhaust fluid tank to said engine control module 300. The quality of the diesel exhaust fluid may include viscosity, color, clarity, and level of pollutants.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention.

Although the invention has been explained in relation to its preferred embodiment, it is to be understood that many other possible modifications and variations can be made without departing from the spirit and scope of the invention.

What is claimed is:

1. A diesel exhaust fluid sensor simulator device for use with and connected between a diesel exhaust fluid head of a diesel exhaust fluid tank and an engine control module of a diesel engine, said diesel exhaust fluid sensor simulator device comprising:

an encasement including:

an interior volume formed by at least one wall; and at least one wiring aperture through said at least one wall;

an electronic circuit board;

wherein said electronic circuit board is located within said interior volume of said encasement;

wherein said electronic circuit board is adapted to retrieve electronic signals from said diesel exhaust fluid head correlating to an actual diesel exhaust fluid level within said diesel exhaust fluid tank, and an actual temperature of said diesel exhaust fluid via a first wire connected therebetween;

wherein said electronic circuit board is adapted to send electronic signals correlating to said actual diesel exhaust fluid level within said diesel exhaust fluid head, and said actual temperature of said diesel exhaust fluid to said engine control module via a second wire connected therebetween; and wherein said electronic circuit board is adapted to produce electronic signals correlating to a chosen diesel exhaust fluid level within said diesel exhaust fluid head, and a chosen temperature of said diesel exhaust fluid and send to said engine control module via a third wire connected therebetween;

said first wire;

wherein said first wire is connected to said electronic circuit board and extends outward therefrom through said at least one wiring aperture, and is adapted to be releasably connected to said diesel exhaust fluid head of said diesel exhaust fluid tank; and wherein said first wire is adapted to retrieve and send said electronic signals correlating to said actual diesel exhaust fluid level within said diesel exhaust fluid tank, and said actual temperature of said diesel exhaust fluid to said electronic circuit board;

said second wire;

wherein said second wire is connected to said electronic circuit board and extends outward therefrom through said at least one wiring aperture, and is adapted to be releasably connected to said engine control module of said diesel engine; and wherein said second wire is adapted to send said electronic signals correlating to said actual diesel exhaust fluid level within said diesel exhaust fluid tank, and said actual temperature of said diesel exhaust fluid retrieved from said diesel exhaust fluid head to said engine control module;

said third wire;

wherein said third wire is connected to said electronic circuit board and extends outward therefrom through said at least one wiring aperture, and is adapted to be releasably connected to said engine control module of said diesel engine; and wherein said third wire is adapted to send said produced electronic signals correlating to said chosen diesel exhaust fluid level within said diesel exhaust fluid tank, and said chosen temperature of said diesel exhaust fluid to said engine control module; and a switch;

wherein said switch is connected to an exterior surface of said encasement;

wherein said switch is electronically connected to said electronic circuit board; and wherein said switch is adapted such that a user can choose between sending said electronic signals of said second wire, said actual diesel exhaust fluid level and temperature, and sending said electronic signals of said third wire, said chosen diesel exhaust fluid level and temperature to said engine control module;

wherein when in use, when said fluid level or temperature readings are out of a predetermined range, which may cause said diesel engine to reduce power or shut down, said user can use said switch to block said out of range readings and instead send said chosen fluid level and temperature readings to said engine control module to regain use and control of said diesel engine.

2. The diesel exhaust fluid sensor simulator device of claim 1, wherein said chosen diesel exhaust fluid level within said diesel exhaust fluid tank correlates to substantially 75% full; and said chosen temperature of said diesel exhaust fluid correlates to substantially 75 degrees Fahrenheit.

3. The diesel exhaust fluid sensor simulator device of claim 1, wherein said electronic circuit board is further adapted to produce electronic signals correlating to a chosen quality of said diesel exhaust fluid within said diesel exhaust fluid tank; and wherein said third wire is adapted to send said produced electronic signals correlating to said chosen quality of said diesel exhaust fluid within said diesel exhaust fluid tank to said engine control module.

4. A combination of an engine control module of a diesel engine, a diesel exhaust fluid head of a diesel exhaust fluid tank, and diesel exhaust fluid sensor simulator device, said combination comprising:

said engine control module including:

an electronic input connector; and an electronic output connector;

wherein said engine control module is adapted to be electronically connected between said diesel exhaust fluid head and an engine of a diesel vehicle;

said diesel exhaust fluid head including:

a sensor;

wherein said sensor is adapted to retrieve information pertaining to diesel exhaust fluid within a diesel exhaust fluid tank;

wherein said diesel exhaust fluid head is adapted to be releasably connected to said diesel exhaust fluid tank; and said diesel exhaust fluid sensor simulator device comprising:

an encasement including:

an interior volume formed by at least one wall; and at least one wiring aperture through said at least one wall;

an electronic circuit board;

wherein said electronic circuit board is located within said interior volume of said encasement;

wherein said electronic circuit board is adapted to retrieve electronic signals from said diesel exhaust fluid head correlating to an actual diesel exhaust fluid level within said diesel exhaust fluid tank, and an actual temperature of said diesel exhaust fluid via a first wire connected therebetween;

wherein said electronic circuit board is adapted to send electronic signals correlating to said actual diesel exhaust fluid level within said diesel exhaust fluid head, and said actual temperature of said diesel exhaust fluid to said engine control module via a second wire connected therebetween; and wherein said electronic circuit board is adapted to produce electronic signals correlating to a chosen diesel exhaust fluid level within said diesel exhaust fluid head, and a chosen temperature of said diesel exhaust fluid and send to said engine control module via a third wire connected therebetween;

said first wire;

wherein said first wire is connected to said electronic circuit board and extends outward therefrom through said at least one wiring aperture, and is adapted to be releasably connected to said diesel exhaust fluid head of said diesel exhaust fluid tank; and wherein said first wire is adapted to retrieve and send said electronic signals correlating to said actual diesel exhaust fluid level within said diesel exhaust fluid tank, and said actual temperature of said diesel exhaust fluid to said electronic circuit board;

said second wire;

wherein said second wire is connected to said electronic circuit board and extends outward therefrom through said at least one wiring aperture, and is adapted to be releasably connected to said engine control module of said diesel engine; and wherein said second wire is adapted to send said electronic signals correlating to said actual diesel exhaust fluid level within said diesel exhaust fluid tank, and said actual temperature of said diesel exhaust fluid retrieved from said diesel exhaust fluid head to said engine control said module;

said third wire;

wherein said third wire is connected to said electronic circuit board and extends outward therefrom through said at least one wiring aperture, and is adapted to be releasably connected to said engine control module of said diesel engine; and wherein said third wire is adapted to send said produced electronic signals correlating to said chosen diesel exhaust fluid level within said diesel exhaust fluid tank, and said chosen temperature of said diesel exhaust fluid to said engine control module; and a switch;

wherein said switch is connected to an exterior surface of said encasement;

wherein said switch is electronically connected to said electronic circuit board; and wherein said switch is adapted such that a user can choose between sending said electronic signals of said second wire, said actual diesel exhaust fluid level and temperature, and sending said electronic signals of said third wire, said chosen diesel exhaust fluid level and temperature to said engine control module;

wherein when in use, when said fluid level or temperature readings are out of a predetermined range, which may cause said diesel engine to reduce power or shut down, said user can use said switch to block said out of range readings and instead send said chosen fluid level and temperature readings to said engine control module to regain use and control of said diesel engine.

5. The combination of claim 4, wherein said chosen diesel exhaust fluid level within said diesel exhaust fluid tank correlates to substantially 75% full; and said chosen temperature of said diesel exhaust fluid correlates to substantially 75 degrees Fahrenheit.

6. The combination of claim 4, wherein said electronic circuit board is further adapted to produce electronic signals correlating to a chosen quality of said diesel exhaust fluid within said diesel exhaust fluid tank; and wherein said third wire is adapted to send said produced electronic signals correlating to said chosen quality of said diesel exhaust fluid within said diesel exhaust fluid tank to said engine control module.

* * * * *